US010825630B2

(12) United States Patent
Pal et al.

(10) Patent No.: US 10,825,630 B2
(45) Date of Patent: Nov. 3, 2020

(54) INTEGRATED MOUNTING POST AND HEAT SINK FOR CONTACTOR ARRANGEMENT IN POWER DISTRIBUTION SYSTEM

(71) Applicant: HAMILTON SUNDSTRAND CORPORATION, Charlotte, NC (US)

(72) Inventors: Debabrata Pal, Hoffman Estates, IL (US); Mark Hamilton Severson, Rockford, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 344 days.

(21) Appl. No.: 15/946,563

(22) Filed: Apr. 5, 2018

(65) Prior Publication Data

US 2019/0311870 A1 Oct. 10, 2019

(51) Int. Cl.

| | |
|---|---|
| ***H01H 50/12*** | (2006.01) |
| ***H01H 33/66*** | (2006.01) |
| ***H01H 49/00*** | (2006.01) |
| ***H01H 50/14*** | (2006.01) |
| *H01H 1/58* | (2006.01) |
| *H01H 50/54* | (2006.01) |

(52) U.S. Cl.

CPC ..... *H01H 50/12* (2013.01); *H01H 49/00* (2013.01); *H01H 50/14* (2013.01); *H01H 1/58* (2013.01); *H01H 50/546* (2013.01); *H01H 2033/6613* (2013.01); *H01H 2239/034* (2013.01); *H01H 2239/072* (2013.01)

(58) Field of Classification Search

CPC ..... H01H 50/12; H01H 49/00; H01H 50/14; H01H 1/58; H01H 50/546; H01H 2033/6613; H01H 2239/034; H01H 2239/072

See application file for complete search history.

(56) References Cited

U.S. PATENT DOCUMENTS

| | | | | |
|---|---|---|---|---|
| 7,837,496 | B1 * | 11/2010 | Pal | H01R 9/2466 361/712 |
| 9,137,925 | B2 | 9/2015 | Pal et al. | |
| 9,855,903 | B1 * | 1/2018 | Pal | H01H 50/12 |
| 2014/0002995 | A1 * | 1/2014 | Pal | H01H 1/62 361/712 |

(Continued)

FOREIGN PATENT DOCUMENTS

| | | |
|---|---|---|
| EP | 3264436 | 1/2018 |
| EP | 3270396 | 1/2018 |
| EP | 3270402 | 1/2018 |

OTHER PUBLICATIONS

European Patent Office European Search Report dated Aug. 6, 2019 in Application No. 19160752.2.

(Continued)

*Primary Examiner* — Mohamad A Musleh

(74) *Attorney, Agent, or Firm* — Snell & Wilmer, L.L.P.

(57) ABSTRACT

A contactor post for an electrical contactor may comprise a body comprising an electrically and thermally conductive material, and a heat sink shunt extending from the body and comprising the electrically and thermally conductive material, wherein the body and the heat sink shunt are comprised of a single piece of the electrically and thermally conductive material.

20 Claims, 7 Drawing Sheets

(56) References Cited

U.S. PATENT DOCUMENTS

2014/0087584 A1* 3/2014 Pal ..... H02B 1/056
439/485
2016/0028216 A1* 1/2016 Pal ..... H02B 1/56
361/676

OTHER PUBLICATIONS

European Patent Office, European Office Action dated Jun. 5, 2020 in Application No. 19160752.2.

* cited by examiner

INTEGRATED MOUNTING POST AND HEAT SINK FOR CONTACTOR ARRANGEMENT IN POWER DISTRIBUTION SYSTEM

FIELD

The present disclosure relates to electrical contactors and, more particularly, to a heat sink for dissipating heat generated by an electrical contactor connected to a mounting panel.

BACKGROUND

Contactor assemblies are used in electrical applications, such as aircraft power distribution systems, where power and current flow control of a multi-phase power distribution system is desired. A contactor arrangement typically has a panel on which several electrical contactors are mounted. Known mounting assemblies used to mount electrical contactors to the panels are constructed of thermally and electrically resistive materials, such as plastics or FR-4 for example.

Each of the contactors is connected to an electrical bus bar, and allows current to flow through the contactor and the corresponding bus bar whenever the contactor is in a closed position. The electrical power and current flow through the contactors is controlled by mechanically actuating a contact plate within the contactor such that, when current flow is desired to pass through the contactor, the contact plate is pushed into electrical contact with two leads and forms an electrical path coupling the leads, thereby allowing current to flow through it. Due to the amount of current traveling from the leads to the connector and the contact resistance at the contact points, waste heat is generated at the contact points and should be removed in order to prevent heat buildup. Additional factors such as imperfections in the contact surfaces or other imperfections can add to the amount of waste heat generated.

SUMMARY

A contactor post for an electrical contactor is disclosed, comprising a body comprising an electrically and thermally conductive material, and a heat sink shunt extending from the body and comprising the electrically and thermally conductive material, wherein the body and the heat sink shunt are comprised of a single piece of the electrically and thermally conductive material.

In various embodiments, the heat sink shunt extends substantially perpendicular from the body.

In various embodiments, the body extends longitudinally between a first end of the contactor post and a second end of the contactor post.

In various embodiments, the heat sink shunt extends from the body at the first end.

In various embodiments, the first end is at least partially defined by a planar surface defined by the body and the heat sink shunt.

In various embodiments, the contactor post comprises an "L" shape.

In various embodiments, the heat sink shunt extends from the body at a location between the first end and the second end.

In various embodiments, the first end is at least partially defined by a stepped surface defined by the body and the heat sink shunt.

In various embodiments, the contactor post comprises a "T" shape.

In various embodiments, the contactor post is plated with a second electrically and thermally conductive material.

An electrical contactor arrangement is disclosed, comprising an insulator defining an aperture, a contactor post extending through the aperture, wherein the contactor post comprises a body comprising an electrically conductive material, and a heat sink shunt extending from the body and comprising the electrically conductive material, wherein the body and the heat sink shunt are comprised of a single piece of the electrically conductive material.

In various embodiments, the electrical contactor arrangement further comprises a first opening disposed in a first end of the body, and a first fastener extending into the first opening, whereby an electrical lead is coupled to the body.

In various embodiments, the electrical contactor arrangement further comprises a second opening disposed in the heat sink shunt, and a second fastener extending into the second opening, whereby a heat sink is coupled to the heat sink shunt.

In various embodiments, the electrical contactor arrangement further comprises a third opening disposed in a second end of the body, and a third fastener extending into the third opening, whereby a bus bar is coupled to the body.

In various embodiments, the electrical contactor arrangement further comprises a first plurality of apertures disposed on a first side of the insulator, a second plurality of apertures disposed on a second side of the insulator, a first plurality of contactor posts extending through the first plurality of apertures, and a second plurality of contactor posts extending through the second plurality of apertures.

In various embodiments, the electrical contactor arrangement further comprises an electrical contactor, the electrical lead coupled between the contactor post and the electrical contactor, a panel, an insulator coupled between the panel and the contactor post, the heat sink coupled between the panel and the heat sink shunt, wherein the panel is thermally coupled to the heat sink shunt via the heat sink, and the bus bar coupled to the contactor post.

In various embodiments, the electrical contactor comprises a moveable member moveable between a first position and a second position.

In various embodiments, the heat sink shunt is in contact with the heat sink.

A method for installing a contactor arrangement is disclosed, comprising positioning a contactor post with respect to a panel, wherein the contactor post comprises a body comprising an electrically conductive material and a heat sink shunt extending from the body, coupling a first end of the contactor post to an electrical lead, coupling a second end of the contactor post to a bus bar, and coupling the heat sink shunt to a heat sink.

In various embodiments, the method further comprises positioning the contactor post to extend through an insulator.

The foregoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration and their best mode. While these exemplary embodiments are described in sufficient detail to enable those skilled in the art to practice the inventions, it should be understood that other embodiments may be realized and that logical, chemical and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Contactors may be cooled by heat sinks for enhanced cooling. Bolted joints may be formed between various members of a contactor arrangement. Joints may add to the resistance of an electrical current flow path, causing additional heat to be generated. In this regard, a contactor arrangement, as disclosed herein, include a contactor post having an integrally formed heat sink shunt. The contactor post having the integrally formed heat sink shunt may tend to reduce heat generation in response to electrical current while tending to increase heat transfer to a heat sink, enhancing cooling of the arrangement.

Figure 1A:
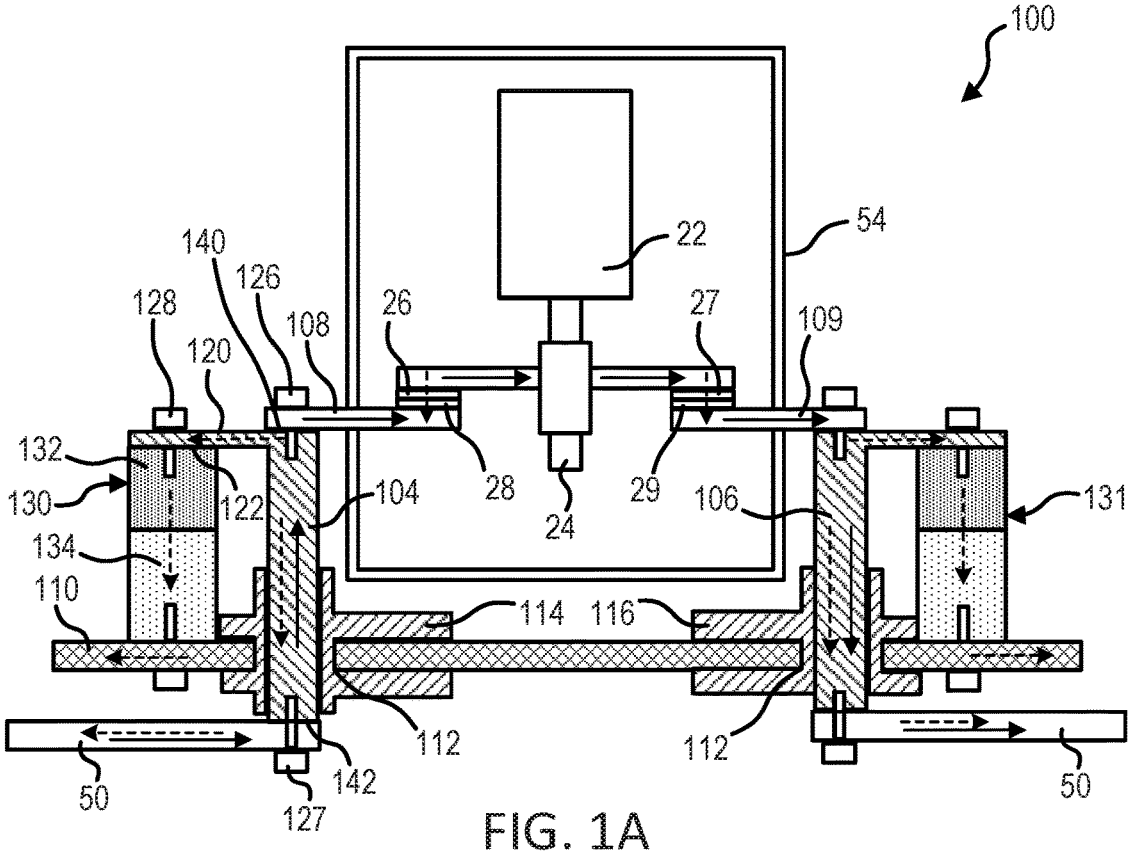
FIG. 1A is a schematic view of an electrical contactor arrangement with a contactor in a closed position, in accordance with various embodiments.
Figure 1B:
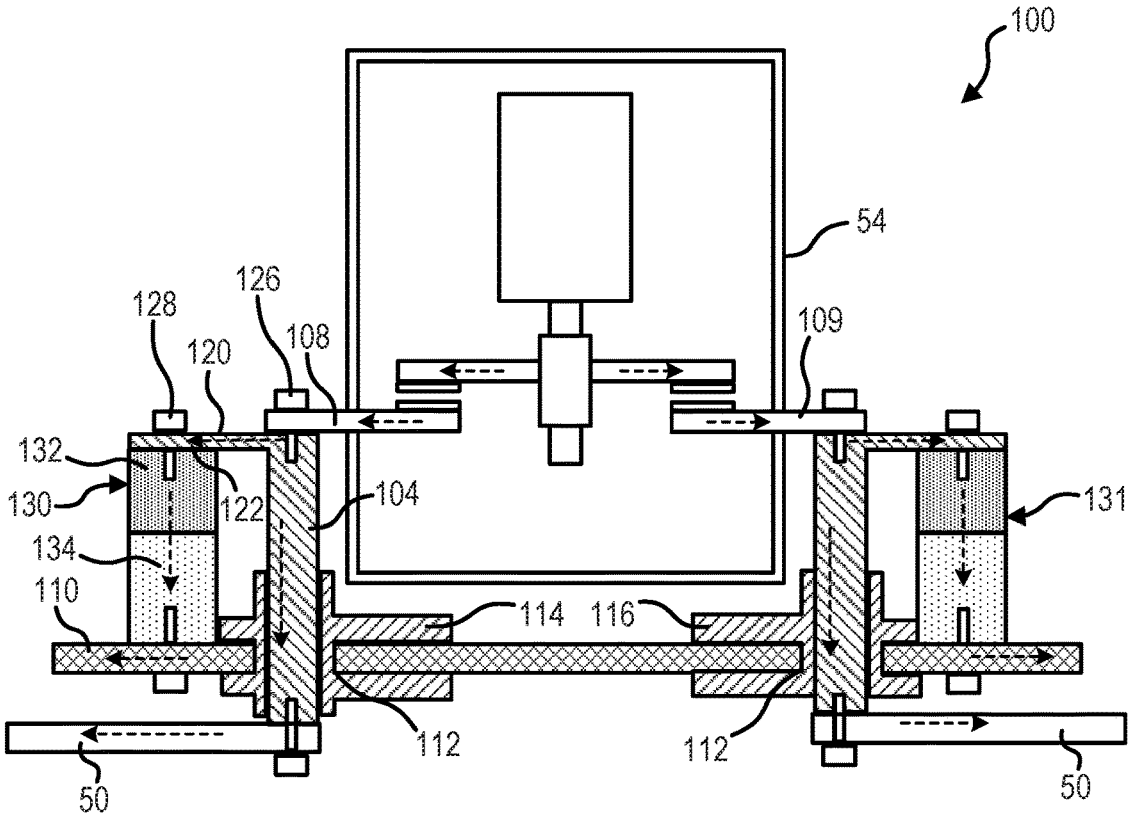
FIG. 1B is a schematic view of an electrical contactor arrangement with a contactor in an open position, in accordance with various embodiments.

Referring now to FIG. 1A and FIG. 1B, a contactor arrangement 100, for connecting an electrical contactor 54 to at least one bus bar 50, is illustrated. The contactor arrangement 100 has at least one post 104 for connecting a contactor 54 to a first side of a bus bar 50 and at least one post 106 for connecting the contactor 54 to a second side of a bus bar 50. The electrical contactor 54 connects to the posts 104, 106 of the contactor arrangement 100 via a set of electrical leads 108, 109 using known thermal and electrical connection techniques.

For example, contactor 54 may comprise a solenoid 22 having a plunger 24 moveable between a first position, as illustrated in FIG. 1A, wherein electrical leads 108, 109 are electrically coupled and a second position, as illustrated in FIG. 1B, wherein electrical leads 108, 109 are electrically decoupled. In the first position, plunger may be positioned such that moveable members (also referred to herein as electrical contacting pads) 26, 27 are in contact with electrical contacting pads 28, 29, respectively, such that current (illustrated by the solid line arrows in FIG. 1A) flows between electrical lead 108 and electrical lead 109. In the second position, illustrated in FIG. 1B, plunger 24 may be positioned such that electrical contacting pads 26, 27 are not in contact with electrical contacting pads 28, 29, respectively, such that current is prohibited from flowing between electrical lead 108 and electrical lead 109, (i.e., an open circuit).

The posts 104, 106 are electrically and thermally coupled to the bus bars 50. The contactor arrangement 100 additionally includes a panel 110 including multiple holes 112 through which the posts 104, 106 extend. In various embodiments, the posts 104, 106 are electrically insulated from panel 110. An insulator 114 may be positioned between post 104 and panel 110 to electrically insulate panel 110 from post 104. An insulator 116 may be positioned between post 106 and panel 110 to electrically insulate panel 110 from post 106. In various embodiments, post 104 and post 106 may be mounted to insulator 114 and insulator 116, respectively. In various embodiments, post 104 and post 106 may be compressed within insulator 114 and insulator 116, respectively. In various embodiments, insulator 114 and insulator 116 may be adhered to post 104 and post 106, respectively. In various embodiments, insulator 114 and insulator 116 may be mounted to panel 110. Insulator 114 and insulator 116 may comprise a non-conductive material, such as a polymer, a plastic, or a glass, among others.

In various embodiments, post 104 may comprise an integrated heat sink shunt 120 extending from post 104. Post 104 and heat sink shunt 120 may be comprised of a single piece of electrically and thermally conductive material, such as aluminum or copper for example. Stated differently, post 104 and heat sink shunt 120 may be comprised of a monolithic piece of electrically and thermally conductive material. In various embodiments, post 104 and heat sink shunt 120 may be made from a single billet of material. Post 104 and heat sink shunt 120 may be manufactured using additive manufacturing methods or subtractive manufacturing methods. During operation, heat is generated between the stationary electrical contacting pads 28, 29 and mobile electrical contacting pads 26, 27, respectively. This heating is caused due to contact electrical resistances between the stationary and mobile contacting pads. Heat from these contacting pads are conducted to the stationary pads (i.e., electrical contacting pads 28, 29), to the posts (i.e., posts 104, 106) and into the heat sink shunts (i.e., heat sink shunt 120). In addition, there is heat generated in solenoid 22. Heat (illustrated by the dashed line arrows in FIG. 1A) may be transferred from solenoid 22, through electrical lead 108, into post 104. This heat may be transferred from post 104 into heat sink shunt 120, through heat sink 130, and into panel 110. This heat may be transferred from post 104 into bus bar 50. Manufacturing heat sink shunt 120 and post 104 as a monolithic piece may prevent heat from being generated at a joint between heat sink shunt 120 and post 104, for example if heat sink shunt 120 and post 104 were manufactured as separate pieces.

In various embodiments, a fastener 126 may extend through electrical lead 108 and first end 140 of post 104, whereby electrical lead 108 is coupled to post 104. A fastener 127 may extend through electrical bus bar 50 and second end 142 of post 104, whereby post 104 is coupled to bus bar 50.

In various embodiments, heat sink shunt 120 may extend substantially orthogonally away from post 104, wherein the term "substantially" in this regard means within five degrees)(±5°). In various embodiments, heat sink shunt 120 and post 104 may comprise an "L" shape. Heat sink shunt 120 may comprise a contacting surface 122 configured to contact a heat sink 130. Heat sink shunt 120 may be located at first end 140.

In various embodiments, heat sink 130 may be mounted to heat sink shunt 120. Heat sink 130 may be mounted to panel 110. Heat sink 130 may extend between heat sink shunt 120 and panel 110. The overall size, shape, and material configuration of the heat sink 130 disclosed herein may be generally determined by the amount of heat to be dissipated. In various embodiments, heat sink 130 may comprise a first portion 132 comprising a first material being electrically non-conductive and thermally conductive, such as aluminum nitride (AlN). In various embodiments, heat sink 130 may comprise a second portion 134 comprising a second material being thermally conductive, such as copper or aluminum. A fastener 128 may extend through heat sink shunt 120 and heat sink 130, whereby heat sink 130 is coupled to heat sink shunt 120.

In various embodiments, a second heat sink 131 may be coupled between panel 110 and post 106, in a similar manner as heat sink 130, panel 110, and post 104.

Figure 2:
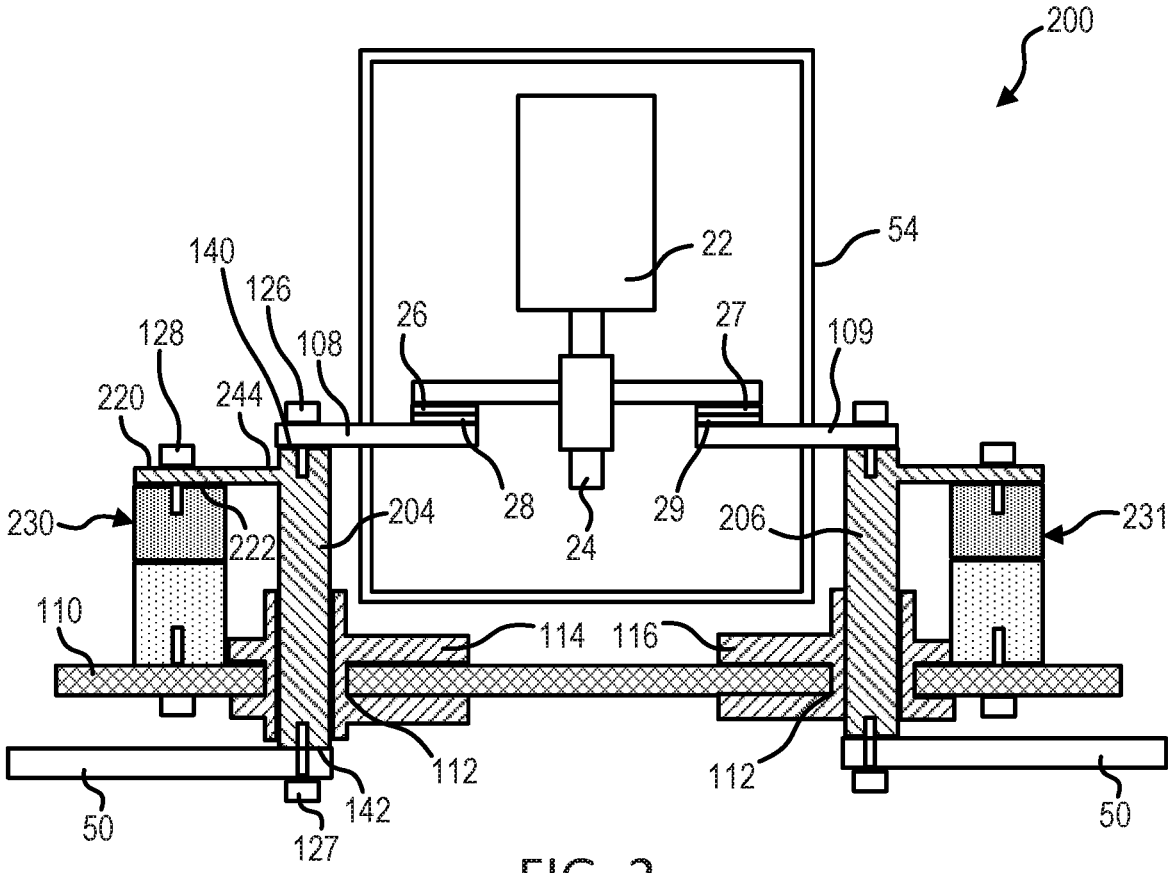
FIG. 2 is a schematic view of an electrical contactor arrangement, in accordance with various embodiments.

With respect to FIG. 2, elements with like element numbering, as depicted in FIG. 1A, are intended to be the same and will not necessarily be repeated for the sake of clarity.

With reference to FIG. 2, a contactor arrangement 200, for connecting electrical contactor 54 to at least one bus bar 50, is illustrated. Contactor arrangement 200 may be similar to contactor arrangement 100 of FIG. 1A, except that heat sink shunt 220 extends from post 204 at a location between first end 140 and second end 142, instead of extending from post 204 at first end 140. In this regard, a step 244 may be defined by heat sink shunt 220 and post 204. In this regard, heat sink shunt 220 and post 204 may comprise a "T" shape. Post 206 may be similar to post 204. Heat sink 230 and heat sink 231 may be similar to heat sink 130 of FIG. 1A.

Figure 3:
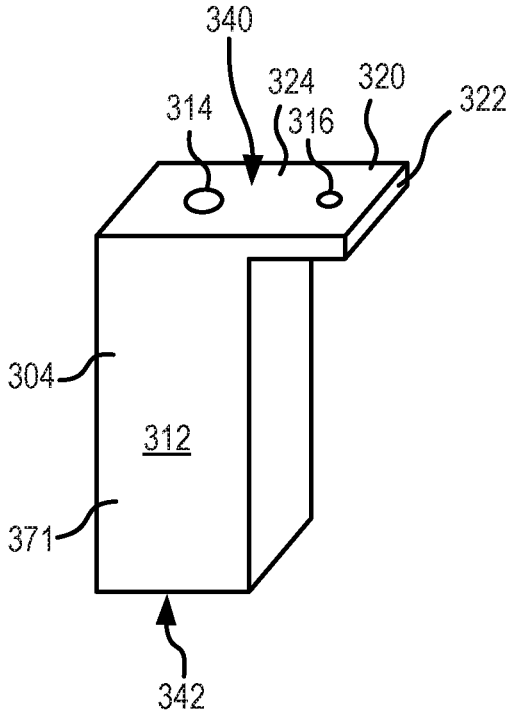
FIG. 3 is an isometric view of an electrical contactor arrangement, in accordance with various embodiments.

With reference to FIG. 3, an isometric view of a post 304 having an integrated heat sink shunt 320 is illustrated, in accordance with various embodiments. In various embodiments, post 104 of FIG. 1A may be similar to post 304. Post 304 may comprise a rectangular body 312 extending between a first end 340 and a second end 342. Heat sink shunt 320 may extend from rectangular body 312. Heat sink shunt 320 may comprise a tab 322. A first opening 314 may be disposed in rectangular body 312 at first end 340. A second opening 316 may be disposed in heat sink shunt 320. First opening 314 and second opening 316 may be configured to receive fasteners, such as fastener 126 and fastener 128, respectively, for example, with momentary reference to FIG. 1A. A smooth, seamless surface 324 may define first end 340. Surface 324 may be defined by rectangular body 312 and heat sink shunt 320. Surface 324 may be a planar surface.

In various embodiments, post 304 may be plated with an electrically and thermally conductive material (also referred to herein as a second electrically and thermally conductive material), such as nickel, silver, or copper for example. Stated differently, post 304 may comprise a conductive material coating 371.

Figure 4:
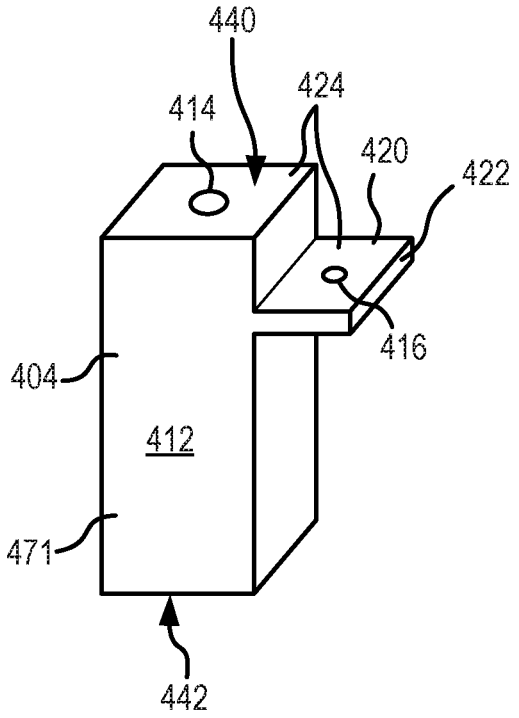
FIG. 4 is an isometric view of an electrical contactor arrangement, in accordance with various embodiments.

With reference to FIG. 4, an isometric view of a post 404 having an integrated heat sink shunt 420 is illustrated, in accordance with various embodiments. In various embodiments, post 204 of FIG. 2 may be similar to post 404. Post 404 may comprise a rectangular body 412 extending between a first end 440 and a second end 442. Heat sink shunt 420 may extend from rectangular body 412. Heat sink shunt 420 may comprise a tab 422. A first opening 414 may be disposed in rectangular body 412 at first end 440. A second opening 416 may be disposed in heat sink shunt 420. First opening 414 and second opening 416 may be configured to receive fasteners, such as fastener 126 and fastener 128, respectively, for example, with momentary reference to FIG. 2. A stepped surface 424 may be defined by rectangular body 412 and heat sink shunt 420.

In various embodiments, post 404 may be plated with an electrically and thermally conductive material, such as nickel or silver for example. Stated differently, post 404 may comprise a conductive material coating 471.

Figure 5A:
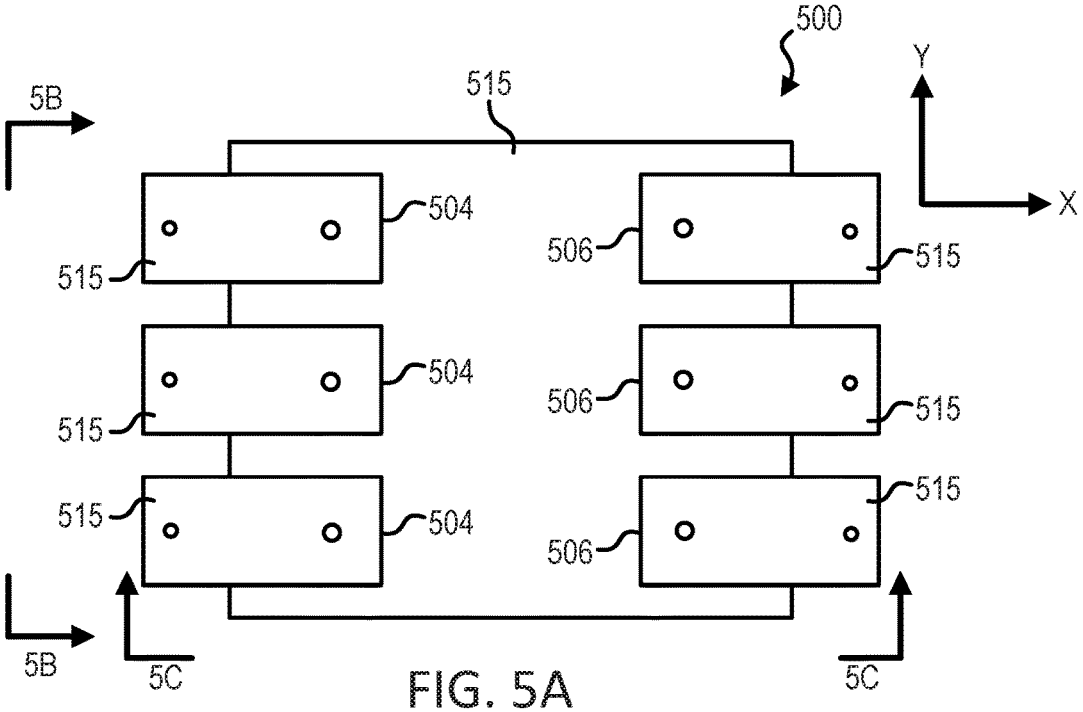
FIG. 5A, FIG. 5B, and FIG. 5C are top, side, and front views, respectively, of a one-piece insulator arrangement for a plurality of contactor posts, in accordance with various embodiments.
Figure 5B:
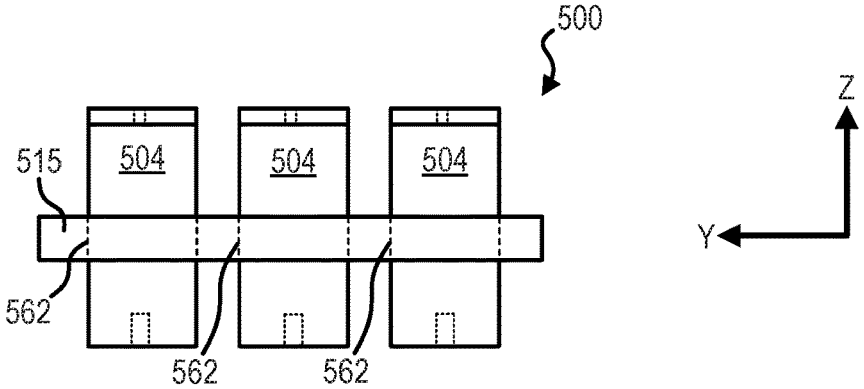
Figure 5C:
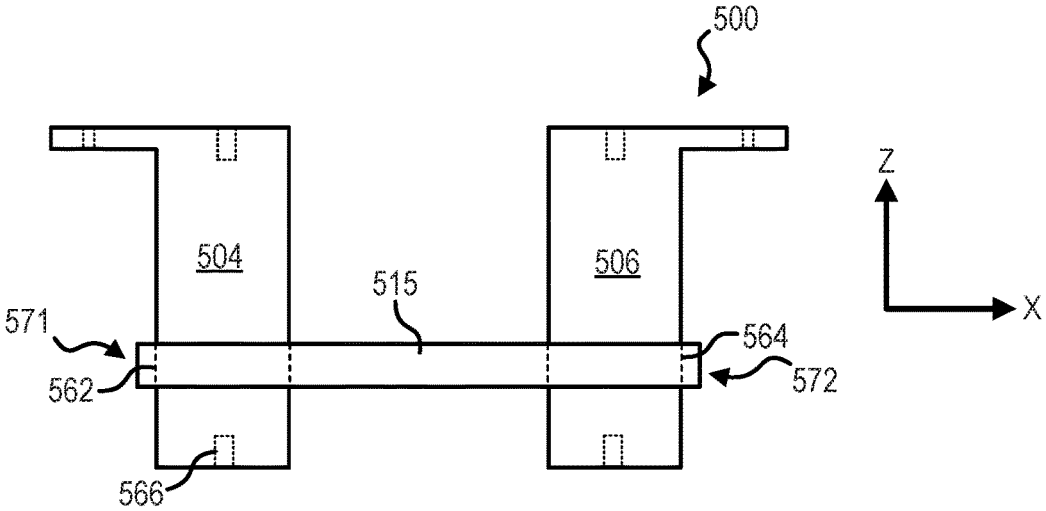

With combined reference to FIG. 5A, FIG. 5B, and FIG. 5C, a contactor post arrangement 500 is illustrated, in accordance with various embodiments. Contactor post arrangement 500 may include an insulator 515 having a first plurality of apertures 562, such as three apertures 562 for example, disposed on a first side 571 of insulator 515 and a second plurality of apertures 564, such as three apertures 564 for example, disposed on a second side 572 of insulator 515. A first plurality of contactor posts 504 may extend through the first plurality of apertures 562. A second plurality of contactor posts 506 may extend through the second plurality of apertures 564. In various embodiments, contactor post arrangement 500 may be symmetric.

In various embodiments, each contactor post 504 may comprise an opening (also referred to herein as a third opening) 566 configured to receive a fastener, such as fastener 127 for example, for coupling contactor posts 504 to a bus bar, such as bus bar 50 for example, with momentary reference to FIG. 1A.

Figure 6A:
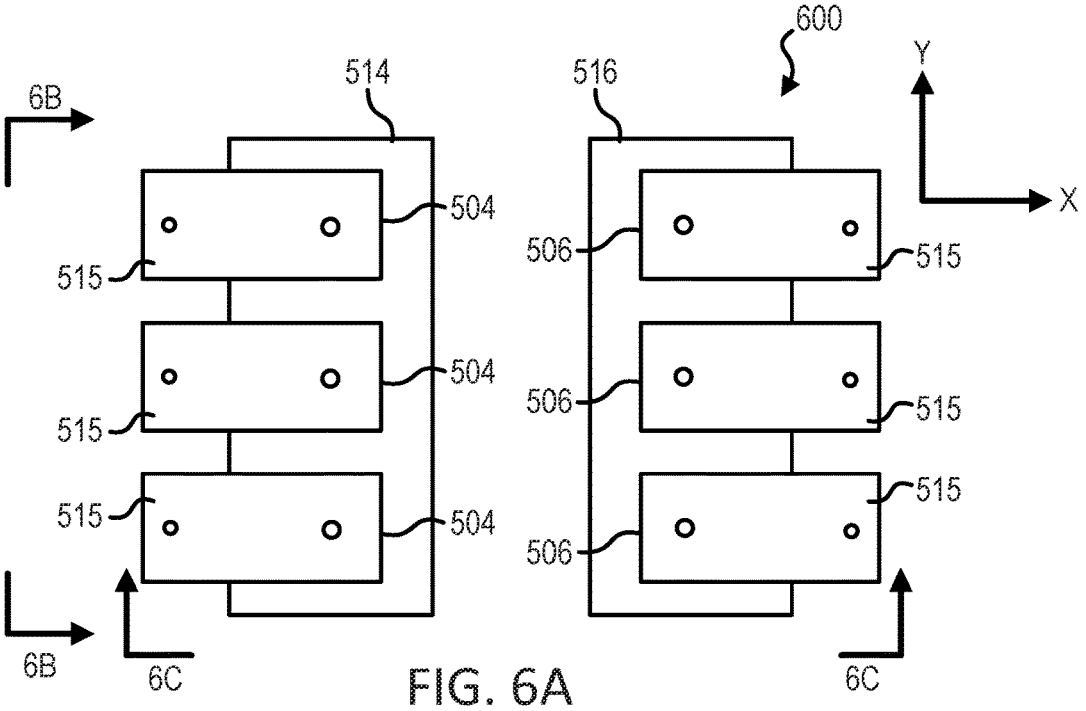
FIG. 6A, FIG. 6B, and FIG. 6C are top, side, and front views, respectively, of a two-piece insulator arrangement for a plurality of contactor posts, in accordance with various embodiments.
Figure 6B:
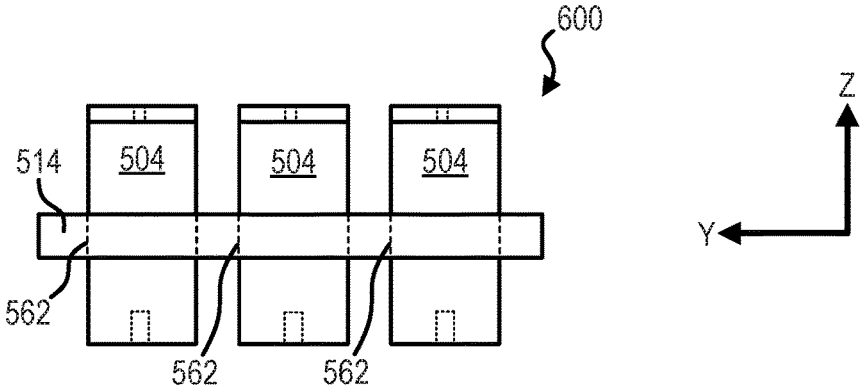
Figure 6C:
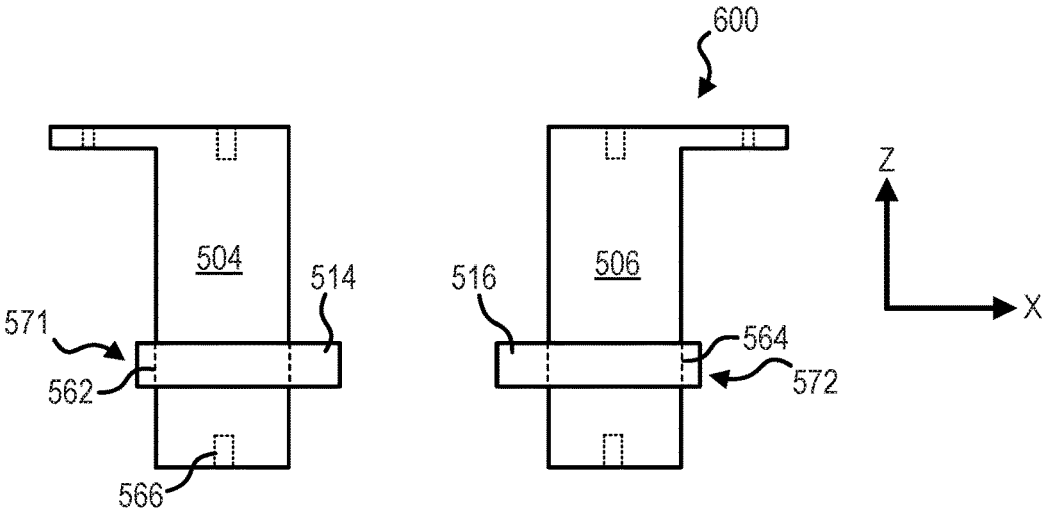

With respect to FIG. 6A, FIG. 6B, and FIG. 6C, elements with like element numbering, as depicted in FIG. 5A, FIG. 5B, and FIG. 5C, are intended to be the same and will not necessarily be repeated for the sake of clarity.

With combined reference to FIG. 6A, FIG. 6B, and FIG. 6C, a contactor post arrangement 600 is illustrated, in accordance with various embodiments. Contactor post arrangement 600 may be similar to contactor post arrangement 500 of FIG. 5A, except that contactor post arrangement 600 includes a two-piece insulator, instead of a one-piece insulator as illustrated in FIG. 5A. In this regard, contactor post arrangement 600 may include a first insulator 514 having a first plurality of apertures 562, such as three apertures 562 for example. Contactor post arrangement 600 may include a second insulator 516 having a second plurality of apertures 564, such as three apertures 564 for example. A first plurality of contactor posts 504 may extend through the first plurality of apertures 562. A second plurality of contactor posts 506 may extend through the second plurality of apertures 564. In various embodiments, contactor post arrangement 600 may be symmetric.

Figure 7A:
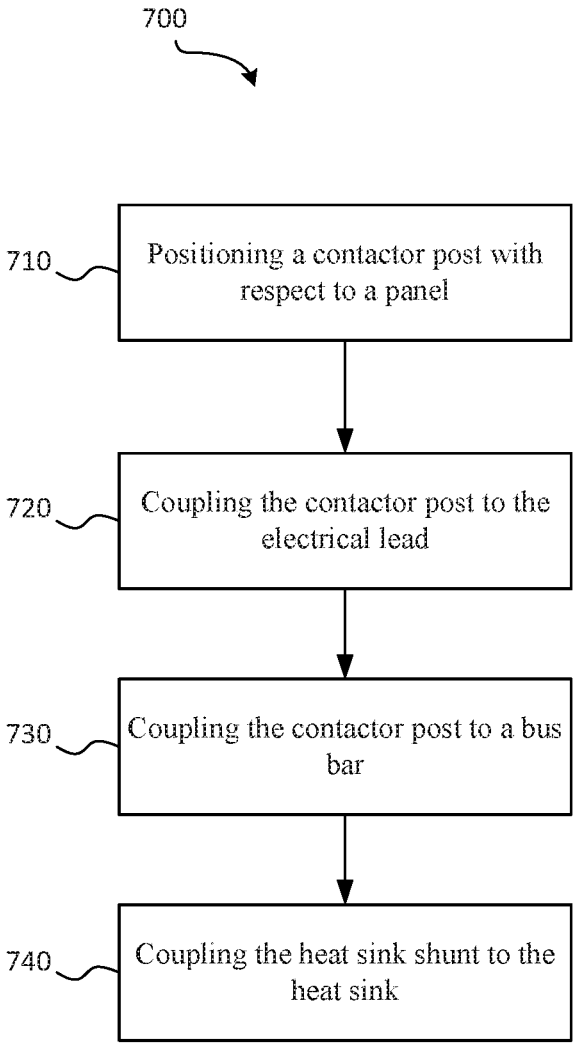
FIG. 7A and FIG. 7B are flow charts illustrating a method of installing an electrical contactor arrangement, in accordance with various embodiments.

With reference to FIG. 7A, a method 700 for installing a contactor arrangement, is illustrated, in accordance with various embodiments. Method 700 includes positioning a contactor post with respect to a panel (step 710). Method 700 includes coupling the contactor post to an electrical lead (step 720). Method 700 includes coupling the contactor post to a bus bar (step 730). Method 700 includes coupling the heat sink shunt to a heat sink (step 740).

With combined reference to FIG. 7A and FIG. 1A, step 710 may include positioning contactor post 104 with respect to panel 110. For example, step 710 may include positioning contactor post 104 to extend through panel 110. Step 720 may include coupling contactor post 104 to electrical lead 108. Step 720 may include positioning fastener 126 to extend through electrical lead 108 and into contactor post 104. In various embodiments, fastener 126 may comprise a screw or bolt. Step 730 may include coupling contactor post 104 to bus bar 50. Step 740 may include coupling heat sink shunt 120 to heat sink 130. Step 740 may include positioning fastener 128 to extend through heat sink shunt 120 and into heat sink 130. In various embodiments, fastener 128 may comprise a screw or bolt.

Figure 7B:
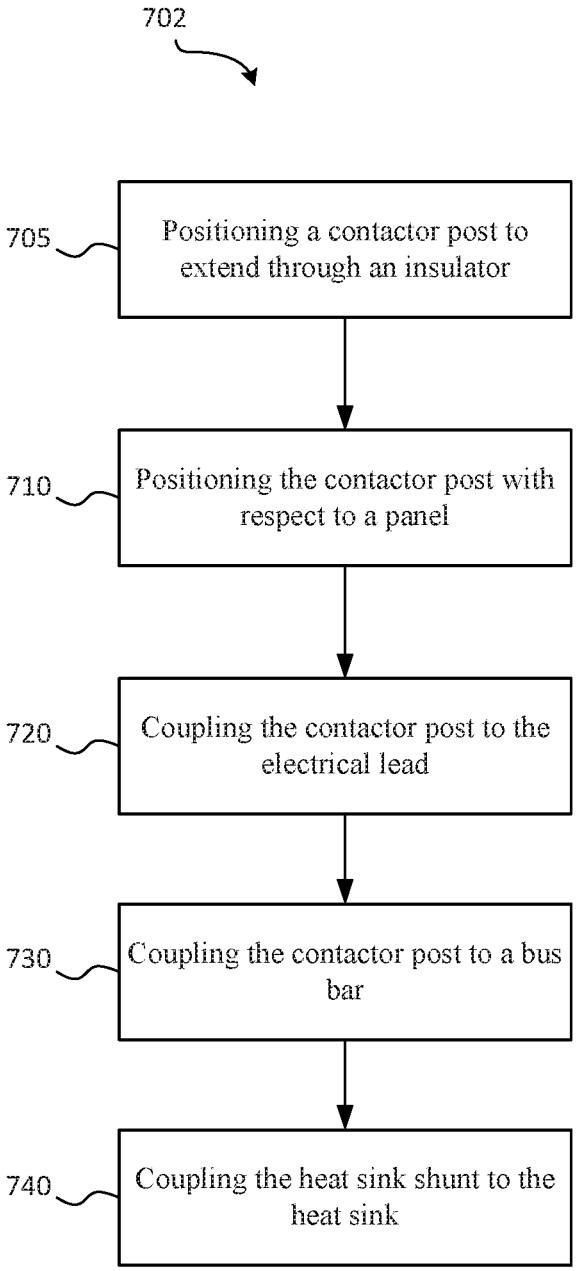

With reference to FIG. 7B, a method 702 for installing a contactor arrangement, is illustrated, in accordance with various embodiments. Method 702 may be similar to method 700 except that method 700 further includes positioning a contactor post to extend through an insulator (step 705). With combined reference to FIG. 7B and FIG. 5C, a contactor post arrangement 600 may comprise a plurality of contactor posts (e.g., contactor posts 504, 506) installed onto an insulator. However, a plurality of contactor posts may not yet be installed onto the insulator. In this regard, step 705 may include positioning contactor post 504 to extend through insulator 515. In various embodiments, step 705 may include positioning contactor post 506 to extend through insulator 515.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is intended to invoke 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. A contactor post for an electrical contactor, comprising:

a body comprising an electrically and thermally conductive material; and a heat sink shunt extending from the body and comprising the electrically and thermally conductive material, wherein a first opening is disposed in a first end of the body, the first opening is configured to receive a first fastener for coupling an electrical lead to the body, a second opening is disposed in the heat sink shunt, the second opening is configured to receive a second fastener for coupling a heat sink to the heat sink shunt, and the body and the heat sink shunt are comprised of a monolithic piece of the electrically and thermally conductive material.

2. The contactor post of claim 1, wherein the heat sink shunt extends substantially perpendicular from the body.

3. The contactor post of claim 1, wherein the body extends longitudinally between a first end of the contactor post and a second end of the contactor post.

4. The contactor post of claim 3, wherein the heat sink shunt extends from the body at the first end.

5. The contactor post of claim 4, wherein the first end is at least partially defined by a planar surface defined by the body and the heat sink shunt.

6. The contactor post of claim 5, wherein the contactor post comprises an "L" shape.

7. The contactor post of claim 3, wherein the heat sink shunt extends from the body at a location between the first end and the second end.

8. The contactor post of claim 7, wherein the first end is at least partially defined by a stepped surface defined by the body and the heat sink shunt.

9. The contactor post of claim 8, wherein the contactor post comprises a "T" shape.

10. The contactor post of claim 1, wherein the contactor post is plated with a second electrically and thermally conductive material.

11. An electrical contactor arrangement, comprising:

an insulator defining an aperture;

a contactor post extending through the aperture, wherein the contactor post comprises:

a body comprising an electrically conductive material; and a heat sink shunt extending from the body and comprising the electrically conductive material, wherein a first opening is disposed in a first end of the body, the first opening is configured to receive a first fastener for coupling an electrical lead to the body, a second opening is disposed in the heat sink shunt, the second opening is configured to receive a second fastener for coupling a heat sink to the heat sink shunt, and the body and the heat sink shunt are comprised of a single piece of the electrically conductive material.

12. The electrical contactor arrangement of claim 11, further comprising:

the first fastener extending into the first opening, and the electrical lead coupled to the body via the first fastener.

13. The electrical contactor arrangement of claim 12, further comprising:

the second fastener extending into the second opening, and the heat sink is coupled to the heat sink shunt via the second fastener.

14. The electrical contactor arrangement of claim 13, further comprising:

a third opening disposed in a second end of the body; and a third fastener extending into the third opening, whereby a bus bar is coupled to the body.

15. The electrical contactor arrangement of claim 11, further comprising:

a first plurality of apertures disposed on a first side of the insulator;

a second plurality of apertures disposed on a second side of the insulator;

a first plurality of contactor posts extending through the first plurality of apertures; and a second plurality of contactor posts extending through the second plurality of apertures.

16. The electrical contactor arrangement of claim 14, further comprising:

an electrical contactor;

the electrical lead coupled between the contactor post and the electrical contactor;

a panel;

the insulator coupled between the panel and the contactor post;

the heat sink coupled between the panel and the heat sink shunt, wherein the panel is thermally coupled to the heat sink shunt via the heat sink; and the bus bar coupled to the contactor post.

17. The electrical contactor arrangement of claim 16, wherein the electrical contactor comprises a moveable member moveable between a first position and a second position.

18. The electrical contactor arrangement of claim 16, wherein the heat sink shunt is in contact with the heat sink.

19. A method for installing a contactor arrangement, comprising:

positioning a contactor post with respect to a panel, wherein the contactor post comprises a body comprising an electrically conductive material, a heat sink shunt extending from the body, a first opening disposed in a first end of the body, and a second opening is disposed in the heat sink shunt;

coupling a first end of the contactor post to an electrical lead via the first opening;

coupling a second end of the contactor post to a bus bar; and coupling the heat sink shunt to a heat sink via the second opening.

20. The method of claim 19, further comprising positioning the contactor post to extend through an insulator.

* * * * *